United States Patent [19]

Daugherity

[11] Patent Number: 4,759,886

[45] Date of Patent: Jul. 26, 1988

[54] METHOD OF ASSEMBLING SHAPED CHARGE PROJECTILES WHICH EMPLOY FLUTED LINERS

[75] Inventor: James C. Daugherity, Buncombe, Ill.

[73] Assignee: Olin Corporation, Stamford, Conn.

[21] Appl. No.: 7,549

[22] Filed: Jan. 28, 1987

[51] Int. Cl.[4] ..... C06D 31/00

[52] U.S. Cl. ..... 264/3.1; 264/3.4; 102/307

[58] Field of Search ..... 264/3.1, 3.4; 102/306–310, 476

[56] References Cited

U.S. PATENT DOCUMENTS

| | | | |
|---|---|---|---|
| 3,613,582 | 10/1971 | Levamaki et al. | 102/306 |
| 3,726,224 | 4/1973 | Pugh et al. | 102/476 |
| 3,777,663 | 12/1973 | Brown | 102/476 |
| 4,004,518 | 1/1977 | Potteiger et al. | 102/476 X |
| 4,034,673 | 7/1977 | Schneider, Jr. | 102/476 X |
| 4,063,512 | 12/1977 | Davis | 102/476 X |
| 4,080,898 | 3/1978 | Gieske | 102/306 |
| 4,178,851 | 12/1979 | Brady | 102/393 |

*Primary Examiner*—Peter A. Nelson
*Attorney, Agent, or Firm*—Bruce E. Burdick

[57] ABSTRACT

A method of assembling a shaped charge projectile employing a fluted liner includes the steps of, first, loading an explosive propellant material in a hollow projectile case, next, preforming a shaped cavity in the propellant material, then, loading a fluted hollow linear into the cavity and, finally, consolidating the propellant material in the projectile case. The consolidation is carried out by engaging the liner with an interface sleeve mounted on an end of a punch and applying consolidating pressure against the propellant material via the sleeve and the liner. The sleeve is composed of resiliently-yieldable and deformable elastomer material having an original shape similar to that of the hollow interior of the liner but without any flutes formed thereon which would match the fluted liner. The consolidating pressure causes the material of the sleeve to deform into a configuration which matches that of the fluted liner but without damaging the same and returns back to its original shape when the pressure is released.

8 Claims, 2 Drawing Sheets

METHOD OF ASSEMBLING SHAPED CHARGE PROJECTILES WHICH EMPLOY FLUTED LINERS

BACKGROUND OF THE INVENTION

1. Field of the Invention

The present invention relates generally to shaped charge projectiles and, more particularly, is concerned with a method of assembling such projectiles that employ fluted liners.

2. Description of the Prior Art

Shaped charge projecticles have been developed to perforate the heavy armor of tanks and other combat vehicles. The shaped charge refers to a conical cavity formed in the front end of an explosive charge contained in the projectile body. The cavity is used to transform the detonation wave propagating through the explosive charge into a convergent shock wave which directs the energy of the explosion along the longitudinal axis of the cavity. Where the cavity contains a thin conical liner, the convergent shock wave causes collapse of the liner inwardly toward the cavity axis and its extrusion from the projectile as a thin, extremely high-velocity, fluid jet along the cavity axis toward the target. U.S. Pat. No. 3,948,181 to Bergstrom discloses several embodiments of shaped charge projecticles and illustrates, in a sequence of steps, the transformation of the thin conical liner into the highvelocity fluid jet for penetrating the armor of the target.

It is well-known that projectiles fired from rifled guns spin in flight and thus have greater accuracy and range than those fired from non-rifled guns. However, the penetrating power of the shaped charge jet is more fully realized when the jet does not spin during flight or, in other words, when it is fired from a nonrifled gun. In order to adapt a shaped charge projectile for use in greater-accuracy rifled weapons, it is common practice to form flutes on the liner. As explained in U.S. Pat. No. 3,726,224 to Pugh et al, the abrupt offset surfaces of the flutes face in the direction in which the projectile rotates under angular momentum imparted by the rifled gun. The offset flute surfaces impart an opposing angular momentum to the liner so that the shaped charge jet emanating from the spinning projectile does not spin and thus has a penetration power comparable or equal to that of a non-spinning projectile.

While the liner flutes have substantially obviated the deleterious effects of projectile spin on the penetration power of the shaped charge jet, they have caused difficulty heretofore in the assembly of the components of the shaped charge projectile. To assemble the projectile, typically four basic steps are involved. First, explosive propellant material, preferably in powder form, is placed in the projectile body. Next, a preformed punch is used to compress and consolidate the propellant powder and to form the conical cavity therein. Then, the fluted conical liner is placed in the cavity. And, finally, the liner is pressed into the cavity as a final consolidation of the powder is performed.

In performing the final step, care must be taken not to damage the flutes so as to adversely affect its ability to counteract the spin of the projectile. One prior art approach to accomplish this has been to provide a punch having an end with flutes formed thereon complementary to and alignable with the flutes of the liner. However, the alignment of the liner flutes with the complementary ones on the punch in an automatic assembly operation can require a great deal of mechanical motion and therefore makes the assembly operation slow and complicated.

Consequently, a need exists for a different approach to accomplishing the assembly of a shaped charge projectile employing a fluted liner. The approach should be one which eliminates the above-described alignment problem without substituting another problem in its place.

SUMMARY OF THE INVENTION

The present invention provides a shaped charge projectile assembly method designed to satisfy the aforementioned needs. The necessity to align the liner flutes with complementary flutes on the consolidating punch has been eliminated in the assembly method of the present invention by the mounting of a replaceable resiliently-yieldable conical interface sleeve, preferably composed of an elastomer material, on the leading end of the punch in place of a fluted end as provided heretofore. The interface sleeve makes contact with the interior of the liner and the yieldable material of the sleeve deforms into the liner flutes without causing any damage thereto as the end of the consolidating punch is pressed into the projectile body. The need for mechanical alignment of the liner flutes to the punch end is thereby eliminated. When the punch is withdrawn, the interface sleeve returns to its original configuration.

Accordingly, the present invention is directed to a method of assembling a shaped charge projectile employing a fluted liner, which method comprises the steps of: (a) loading an explosive propellant material in a hollow projectile body; (b) preforming a shaped cavity in the propellant material; (c) loading a fluted hollow liner into the cavity; and (d) consolidating the propellant material in the projectile body by applying pressure against the propellant material through the liner and a sleeve having an original shape adapted to fit within the liner and being composed of material which resiliently deforms so as not to damage the fluted liner upon the application of the consolidating pressure but which returns to its original shape when the application of pressure is released.

More particularly, the consolidating step includes mounting the sleeve on the end of a punch used to apply the consolidating pressure and then engaging the liner with the sleeve. Furthermore, the sleeve is composed of resiliently-yieldable and deformable material having an original shape similar to that of the hollow interior of the liner but without any flutes formed thereon which would match the flutted liner. The pressure is applied against propellant material via the sleeve and liner such that the material of the sleeve deforms into a configuration which matches that of the fluted liner without damaging the same and returns back to its original shape when the pressure is released. The sleeve is preferably composed of an elastomer material.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWING

In the course of the following detailed description, reference will be made to the attached drawings in which.

DETAILED DESCRIPTION OF THE INVENTION

Figure 1:
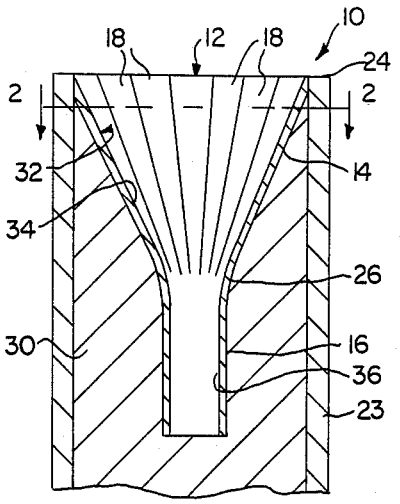
FIG. 1 is a fragmentary axial sectional view of an assembled shaped charged projectile showing a fluted liner employed therein.
Figure 2:
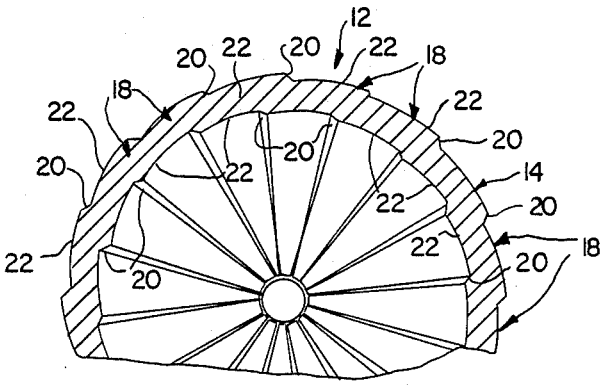
FIG. 2 is an enlarged fragmentary sectional view of the fluted liner of the shaped charge projectile taken along line 2—2 of FIG. 1.

Referring now to the drawings, and particularly to FIG. 1, there is shown the forward end portion of a shaped charge projectile, generally designated 10, which employs a fluted liner 12 and is assembled in accordance with the method of the present invention. The fluted liner 12 may be fabricated from sheet metal such as copper, aluminum, steel or other suitable material and has a forward conical portion 14 and a rear cylindrical portion 16. A plurality of flutes 18 are formed in the forward conical portion 14 of the liner 12. Referring also to FIG. 2, the flutes 18 are equally circumferentially spaced about the liner forward conical portion 14. Each flute 18 includes an abrupt offset surface 20 joined to the next adjacent offset surface by a canted surface 22 which surfaces 20, 22 extend from the base end 24 to the apex end 26 of the liner forward conical portion 14. The offset surfaces 20 lie in planes which each makes a small angle with respect to a radial plane through the longitudinal axis of the sleeve 12. The offset surfaces 20 also face in the direction in which the projectile 10 will rotate upon being fired from a rifled weapon (not shown).

In addition to the fluted liner 12, the shaped charge projectile 10 includes a cylindrical case 28 which is filled with a suitable explosive propellant 30. The propellant 30 has a hollow cavity 32 formed therein which includes an outer conical region 34 and an inner cylindrical region 36 sized to respectively receive the forward conical and rear cylindrical portions 14, 16 of the liner 12. A primer (not shown) is ordinarily disposed at the rear end of the projectile 10. The primer is used to detonate the propellant 30 and produce a detonation wave therein which ultimately coacts with the outer conical region 34 of the cavity to produce the high-velocity, armor-piercing fluid jet.

Figure 3:
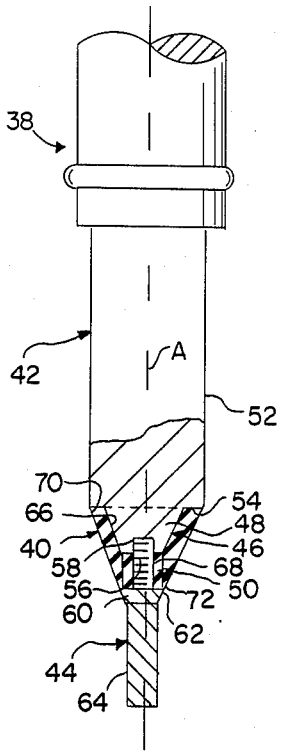
FIG. 3 is a fragmentary side elevational view, with a portion broken away and sectioned, of a compression punch assembly having a resiliently-yieldable conical-shaped interface sleeve mounted on the leading end of the punch.

However, in order to obtain the maximum penetration power capability of the fluted liner 12, its flutes 18 must not be damaged during assembling of the projectile 10. A compression or consolidation punch assembly, generally indicated by 38 in FIG. 3, is provided with a resiliently-yieldable, conical-shaped hollow interface sleeve 40 for achieving this purpose. The sleeve 40 is preferably composed of an elastomer material, such as DISOGRIN® compound 9250 (made by Disogrin Industries of Manchester, N.H.) having the following properties: A moldable urethane compound with a shore hardness of 92 (specification list enclosed).

The punch assembly 38 is composed of a punch member 42, a guide member 44 and the aforementioned interface sleeve 40. The punch member 42 has an end tip 46 which includes an inner conical head portion 48, being free of any flutes such as was provided heretofore, and an outer cylindrical neck portion 50. The conical head portion 48 at its top is offset and spaced radially toward the longitudinal axis A of the punch member 42 and from the outer surface 52 thereof so as to define an annular abutment shoulder 54. From its top, the conical head portion 44 covergently tapers to its bottom where it merges into the outer cylindrical neck portion 50. The portions 48, 50 of the end tip 46 have a central threaded bore 56 tapped therein.

The guide member 44 of the punch assembly 42 includes an inner threaded stud 58 which is threaded into the bore 56 in the punch member end tip 46. A flared rim 60 on the guide member 44 immediately axially outwardly of the stud 58 seats against the outer neck portion 50 of the end tip 46 when the stud 58 is fully threaded into the bore 56. The diameter of the top of the rim 60 is greater than that of the end tip neck portion 50 such that the flared rim 60 defines an annular ledge 62 which surrounds and extends radially outwardly from the neck portion 50. The bottom of the flared rim 60, which is smaller in diameter than the top thereof, merges into a cylindrical guide pin 64 having a diameter and length sized to fit within the rear cylindrical portion of the liner 12.

Figure 4:
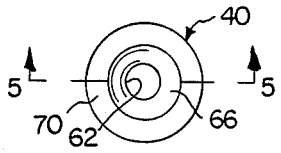
FIG. 4 is a top plan view of the sleeve removed from the punch assembly.
Figure 5:
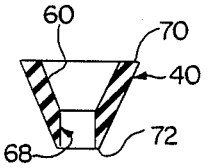
FIG. 5 is an axial sectional view of the sleeve taken along line 5—5 of FIG. 4.

Referring now to FIGS. 4 and 5 as well as to FIG. 3, the elastomer interface sleeve 40 is applied on the tip end 46 of the punch member 42, over the inner conical head portion 48 and outer cylindrical neck portion 50 thereof, before the guide member 44 is threaded to the end tip. The interface sleeve 40 has an upper tapered bore 66 which merges into a lower cylindrical bore 68. The upper bore 66 of the sleeve 40 receives the conical head portion 48 of the punch member end tip 46, whereas the lower bore 68 of the sleeve receives the cylindrical neck portion 50 of the end tip. Also, the upwardly-facing top end annular surface 70 of the sleeve 40 engages the downwardly-facing annular abutment shoulder 54 on the punch member 42 which surrounds its end tip 46. Once the guide member 44 is threaded onto the end tip 46 after installation of the interface sleeve 40, the annular ledge 62 on the guide member rim 60 engages the downwardly-facing bottom end 72 of the sleeve 40 to retain it on the punch member end tip 46, being captured between the abutment shoulder 54 and the annular ledge 62.

Figure 6A:
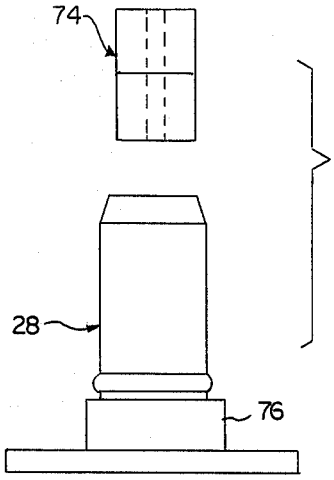
FIGS. 6A-6D are schematical views depicting the sequence of steps employed by the method of assembling the components of the shaped charge projectile of FIG. 1.
Figure 6B:
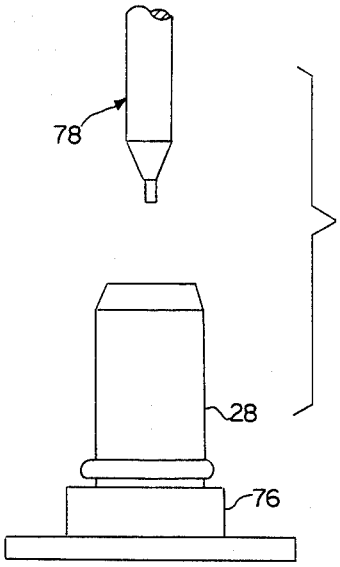
Figure 6C:
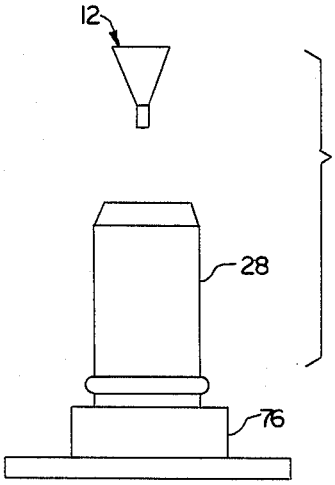

Turning now to FIGS. 6A-6D, there is shown schematically the sequence of steps comprising the method of the present invention for assembling the shaped charge projectile 10 wherein the elastomer interface sleeve 40 is used to avoid damaging the fluted liner 12. In FIG. 6A, a charge 74 of explosive propellant 30, being in pellet or powder form, is loaded into the hollow interior of the projectile case 28 as it is supported and indexed by a carrier cup 76 through the first of a plurality of stations of a conventional automatic assembling system. At the second station shown in FIG. 6B, a preform punch 78 is driven downwardly to preform the shaped cavity 32 (FIG. 1) in the propellant material 30. Then, at the next station seen in FIG. 6C, the fluted hollow liner 12 is loaded by any suitable means into the cavity 32 in the propellant 30 contained in the projectile case 28.

Figure 6D:
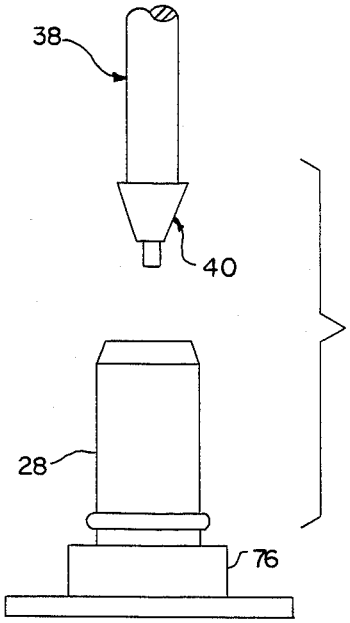

Finally, at the fourth station seen in FIG. 6D, the punch assembly 38, previously described with reference to FIG. 3, is used to consolidate the propellant material 30 in the projectile case 28. The punch member 42 of the assembly 38 applies the desired level of pressure against the propellant material 30 through the liner 12 and the elastomer interface sleeve 40, beng carried on the end tip 46 of the punch member, which fits within and engages the liner 12. As explained above, the sleeve 40 has an original conical shape adapted to fit within the fluted liner 12 and is composed of elastomer material which resiliently deforms so as not to damage the fluted liner upon the application of the consolidating pressure but which returns to its original shape when the application of pressure is released. Although the sleeve 40 does not have any flutes formed thereon which would match the fluted liner 12, the application of consolidating pressure to the sleeve causes its material to deform into a configuration which matches that of the fluted liner without damaging the same and then deform back to its original shape when the pressure is released.

It should be realized that although the interface sleeve 40 is capable of being used many cycles, it is readily replaceable once it has reached its useful life. Also, the method of the present invention described above can be carried out at a consolidating pressure of 35,000 psi for both the preforming and final consolidation steps, using a fifteen ton press.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A method of assembling a shaped charge projectile employing a fluted liner, comprising the steps of:

(a) loading an explosive propellant material in a hollow projectile body;

(b) preforming a shaped cavity in the propellant material;

(c) loading a fluted hollow liner at least partially into the preformed shaped cavity; and (d) consolidating the propellant material in the projectile body by compressing a resilient conical sleeve against the fluted hollow liner so as to press the loaded liner deeper into the cavity to thereby consolidate the propellant material by application of indirect pressure applied through the liner, said sleeve having an original shape adapted to fit withing the liner and being composed of material which resiliently deforms so as not to damage the fluted liner upon the application of the consolidating pressure and which returns to its original shape when the application of pressure is released.

2. The method as recited in claim 1, wherein said consolidating step includes engaging the liner with the sleeve.

3. The method as recited in claim 2, wherein said consolidating step includes mounting the sleeve on the end of a punch used to apply the consolidating pressure.

4. A method of assembling a shaped charge projectile employing a fluted liner, comprising the steps of:

(a) loading an explosive propellant material in a hollow projectile body;

(b) preforming a shaped cavity in the propellant material;

(c) loading a fluted hollow liner at least partially into the preformed shaped cavity; and (d) consolidating the propellant material in the projectile body by applying pressure compressing a resilient conical sleeve against the fluted hollow liner so as to press the loaded liner deeper into the cavity to thereby consoliate the propellant material by application of indirect pressure applied through the liner, wherein the sleeve is composed of resiliently-yieldable and deformable material having an original shape similar to that of the hollow interior of the liner but without any flutes formed thereon which would match the fluted liner and being composed of material which resiliently deforms so as not to damage the fluted liner upon the application of the consolidating pressure and which returns to its original shape when the application of pressure is released.

5. The method as recited in claim 1, wherein said consolidating step also includes applying pressure against the propellant material via the sleeve and liner such that the material of the sleeve deforms into a configuration which matches that of the flued liner without damaging the same and returns back to its original shape when the pressure is released.

6. The method as recited in claim 1, wherein the sleeve is composed of an elastomer material.

7. A method of assembling a shaped charge projectile employing a fluted liner, comprising the steps of:

(a) loading an explosive propellant material in a hollow projectile body;

(b) preforming a shaped cavity in the propellant material;

(c) loading a fluted hollow liner into the cavity; and (d) consolidating the propellant material in the projectile body by (i) engaging the liner with an interface sleeve mounted on an end of a punch, the sleeve being composed of resiliently-yieldable and deformable material having an original shape similar to that of the hollow interior of the liner but without any flutes formed thereon which would match the fluted liner, and (ii) applying pressure against the propellant material via the sleeve and liner such that the material of the sleeve deforms into a configuration which matches that of the fluted liner but without damaging the same and returns back to its original shape when the pressure is released.

8. The method as recited in claim 6, wherein the sleeve is composed of an elastomer material.

* * * * *